US009620004B2

(12) United States Patent
Toebes et al.

(10) Patent No.: US 9,620,004 B2
(45) Date of Patent: Apr. 11, 2017

(54) MULTI-MASTER WIRELESS REMOTE CONTROL

(71) Applicant: Cisco Technology, Inc., San Jose, CA (US)

(72) Inventors: John Toebes, Cary, NC (US); Mary Ellen Toebes, Cary, NC (US)

(73) Assignee: Cisco Technology, Inc., San Jose, CA (US)

( * ) Notice: Subject to any disclaimer, the term of this patent is extended or adjusted under 35 U.S.C. 154(b) by 282 days.

(21) Appl. No.: 14/476,765

(22) Filed: Sep. 4, 2014

(65) Prior Publication Data

US 2016/0071407 A1 Mar. 10, 2016

(51) Int. Cl.
*G08C 17/02* (2006.01)
*A63H 30/04* (2006.01)

(52) U.S. Cl.
CPC ..... *G08C 17/02* (2013.01); *A63H 30/04* (2013.01); *G08C 2201/20* (2013.01)

(58) Field of Classification Search
CPC ..... A63H 30/04; G08C 17/02; G08C 2201/20
See application file for complete search history.

(56) References Cited

PUBLICATIONS

AR.Drone 2.0. Parrot New Wi-Fi Quadricopter: 2013 (9 pages) available at the web at: http://ardrone2.parrot.com/
First Tech Challenge, Samantha Wi-Fi Module Readme (10 pages) available at the web at: http://www.usfirst.org/sites/default/files/docs/Samantha_Module_Readme/Samantha_Module_Readme.html.
Parrot News, Parrot AR.Drone 2.0; Jan. 2014 (4 pages) available at the web at: http://blog.parrot.com/2014/01/06/parrot-ar-drone-2-0-even-more-piloting-possibilities/.
Roku, Android Apps on Google Play; Apr. 2014 (3 pages) available at the web at: https://play.google.com/store/apps/details?id=com.roku.remote.
Spektrum, Bind-N-Fly Technology, 2005-2014 (2 pages) available at the web at: http://www.spektrumrc.com/Technology/BindNFly.aspx.
Spektrum Airware, DX9 Transmitter Only Mode 1-4 in MD2 Config; 2005-2014 (3 pages) available at the web at: http://www.spektrumrc.com/Products/Default.aspx?ProdID=SPMR9900.
UsFirst, Welcome to the First Tech Challenge (2 pages) available at the web at: http://www.usfirst.org/roboticsprograms/ftc.
(Continued)

*Primary Examiner* — Sisay Yacob
(74) *Attorney, Agent, or Firm* — Samuel M. Katz

(57) ABSTRACT

In one embodiment, a first controlling device includes a processor to send a first pairing request to a remote device, receive a grant of access from the remote device, receive user input commands, receive a second pairing request from a second controlling device, grant access to the second controlling device, receive control commands from the second controlling device, and send control commands to the remote device based on the control commands received from the second controlling device and the user input commands, after the first controlling device loses a connection with the remote device, the processor being operative to send a third pairing request to the remote device and receive a denial of the third pairing request and an identification of the second controlling device from the remote device, send a fourth pairing request to the second controlling device, receive a grant of access from the second controlling device.

17 Claims, 18 Drawing Sheets

(56) References Cited

PUBLICATIONS

Vex Robotics, Partner Joystick (2 pages) available at the web at: http://www.vexrobotics.com/276-1891.html.
Vexnet, Joystick (2 pages) available at the web at: http://www.vexrobotics.com/vex/products/accessories/control/276-2192.html.
Wikipedia, Animatronics (3 pages) available at the web at: http://en.wikipedia.org/wiki/Animatronics.

MULTI-MASTER WIRELESS REMOTE CONTROL

TECHNICAL FIELD

The present disclosure generally relates to remote control of remote devices.

BACKGROUND

Some systems enable the control of a robot or other device with more than one person controlling the robot or other device while working in tandem using separate remote control devices. Some systems allow two remote control devices that are not physically tied to one another allowing for freer movement of the individuals controlling the single device.

BRIEF DESCRIPTION OF THE DRAWINGS

The present disclosure will be understood and appreciated more fully from the following detailed description, taken in conjunction with the drawings in which.

DESCRIPTION OF EXAMPLE EMBODIMENTS

Overview

Figure 1:
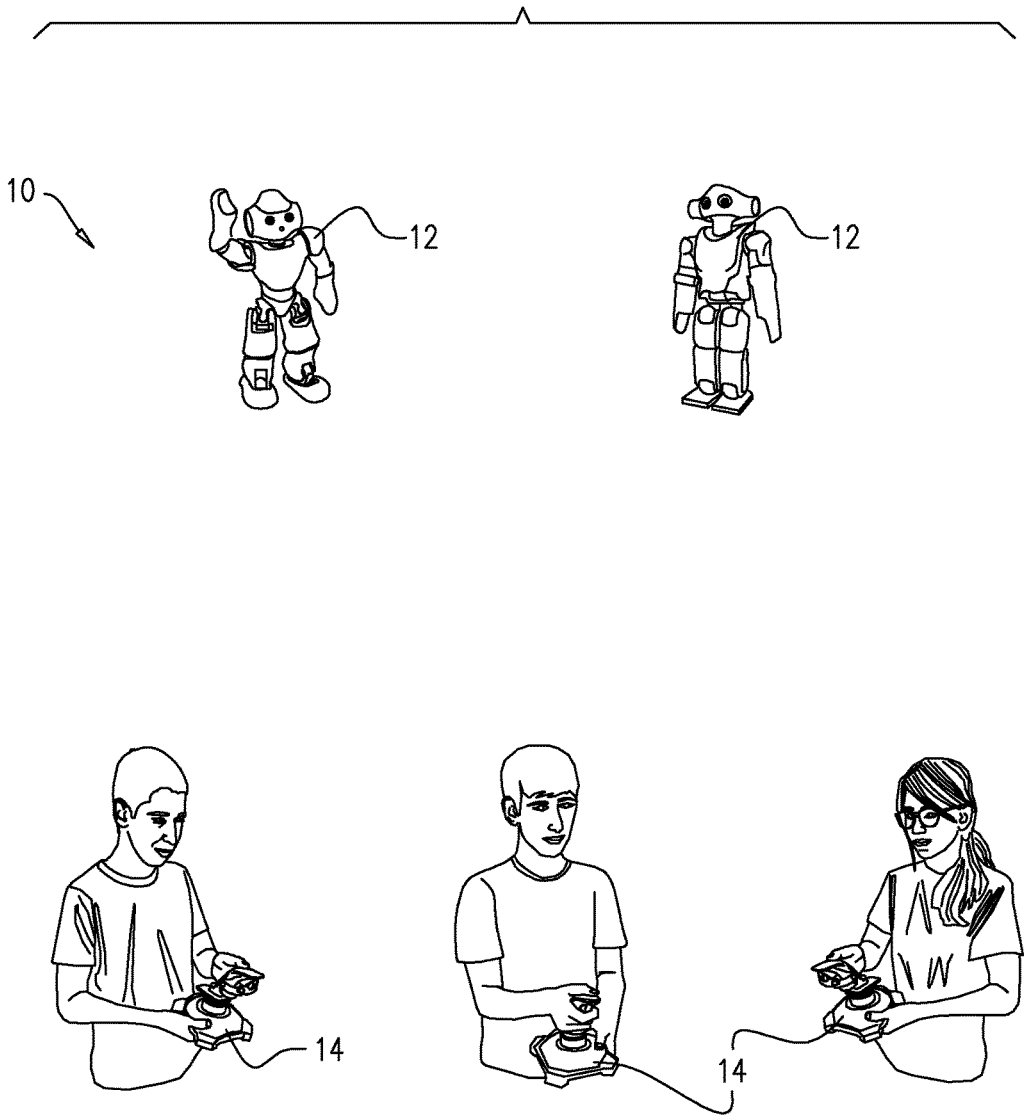
FIG. 1 is a pictorial view of wireless remote control system constructed and operative in accordance with an embodiment of the present invention.

There is provided in accordance with an embodiment of the present invention, a first controlling device including a processor, a memory to store data used by the processor, and a user input interface, wherein the processor is operative to wirelessly send a first pairing request to a remote device, wirelessly receive a grant of access from the remote device, receive user input commands from the user input interface for controlling the remote device, wirelessly receive a second pairing request from a second controlling device, wirelessly grant access to the second controlling device, wirelessly receive control commands from the second controlling device for controlling the remote device, and wirelessly send control commands to the remote device for controlling the remote device based on the control commands received from the second controlling device and the user input commands from the user input interface, wherein, after the first controlling device loses a connection with the remote device, the processor is operative to wirelessly in response to losing the connection, send a third pairing request to the remote device, receive a denial of the third pairing request and an identification of the second controlling device from the remote device, in response to receiving the denial, send a fourth pairing request to the second controlling device, receive a grant of access from the second controlling device, and send control commands to the second controlling device for controlling the remote device based on the user input commands from the user input interface.

There is also provided in accordance with another embodiment of the present invention, a second controlling device including a processor, a memory to store data used by the processor, and a user input interface, wherein the processor is operative to wirelessly send a first pairing request to a remote device, wirelessly receive a denial of the first pairing request and an identification of a first controlling device from the remote device, in response to receiving the denial, wirelessly send a second pairing request to the first controlling device, wirelessly receive a grant of access from the first controlling device, receive user input commands from the user input interface for controlling the remote device, and wirelessly send control commands to the first controlling device for controlling the remote device based on the user input commands from the user input interface.

There is also provided in accordance with still another embodiment of the present invention, an apparatus including a processor, and a memory to store data used by the processor, wherein the processor is operative to wirelessly receive a first pairing request from a first controlling device, send a grant of access to the first controlling device, receive control commands from the first controlling device for controlling a remote device, receive a second pairing request from a second controlling device, and send a denial of the second pairing request and an identification of the first controlling device to the second controlling device.

DEFINITIONS

Persons skilled in the art will appreciate that, throughout the present application, a robotic device is used by way of example only, and that the present invention is not limited to a particular type of remote device, but rather includes any suitable device which is controlled remotely by a controlling device.

DESCRIPTION CONTINUED

Reference is now made to FIG. 1, which is a pictorial view of a wireless remote control system 10, constructed and operative in accordance with an embodiment of the present invention.

The wireless remote control system 10 is operative to enable a plurality of users to operate a remote device 12 using independent remote controls 14, for example, pointing devices such as a joystick in tandem. It will be appreciated that the remote controls 14 may be any suitable remote control. FIG. 1 shows two remote devices 12. It is generally desirable that the remote controls 14 are not physically connected to each other or to the remote device 12.

Figure 2:
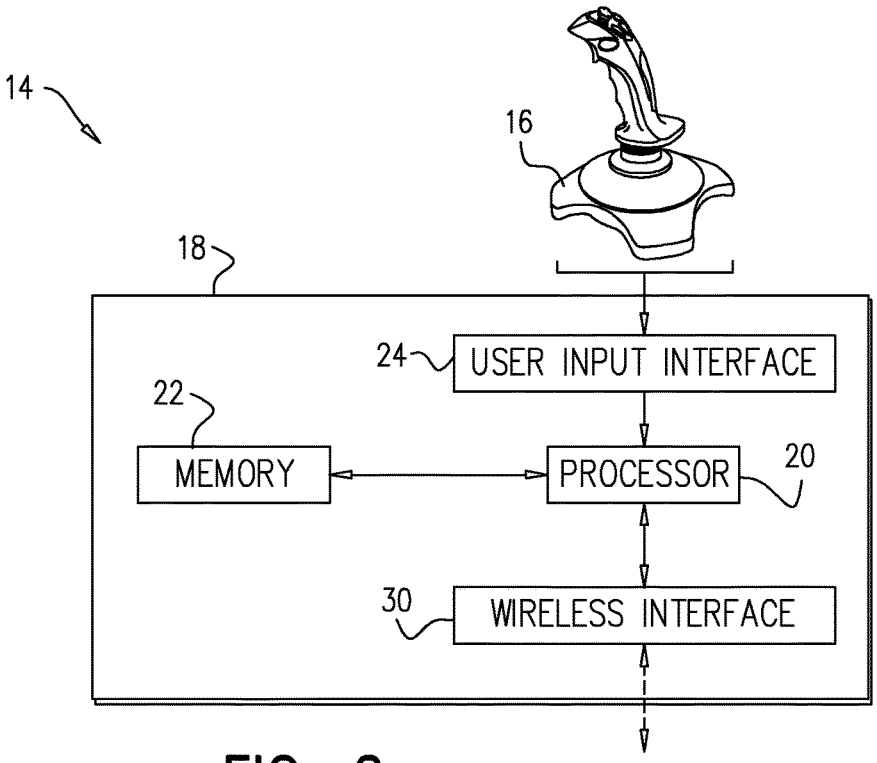
FIG. 2 is a partly pictorial, partly block diagram view of a pointing device and wireless controlling device for use in the system of FIG. 1.

Reference is now made to FIG. 2, which is a partly pictorial, partly block diagram view of a pointing device 16 and a wireless controlling device 18 for use in the system of FIG. 1.

Each remote control 14 typically includes: the pointing device 16 or other user input device such as a keypad, touchpad or voice activation input device or any suitable combination thereof; and the wireless controlling device 18.

The wireless controlling device 18 typically includes: a processor 20; a memory 22 to store data used by the processor 20; a user input interface 24; and a wireless interface 30 for communicating with the remote devices 12 (FIG. 1) and the wireless controlling devices of other users. The user input interface 24 is operative to receive user input commands from the pointing device 16 or other suitable user input device. The pointing device 16 and the wireless controlling device 18 may be operationally connected via any suitable connection, for example, but not limited to, via a USB connection or other suitable connector. The pointing device 16 and the wireless controlling device 18 may be implemented as a single unit.

Figure 3:
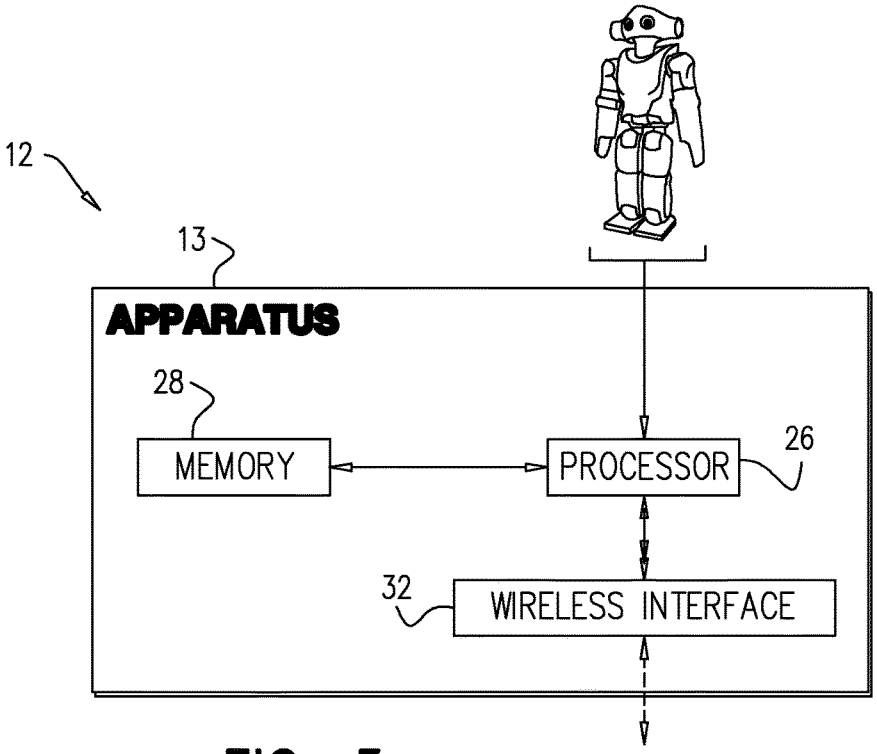
FIG. 3 is a remote device for use in the system of FIG. 1.

Reference is now made to FIG. 3, which is one of the remote devices 12 for use in the system 10 of FIG. 1.

The remote device 12 includes an apparatus 13 including: a processor 26; a memory 28 to store data used by the processor 26; and a wireless interface 32 for communicating with the wireless controlling devices 18 of the users. The apparatus 13 may be integrated with the remote device 12 or removably attachable to the remote device 12 via a suitable connection, for example, but not limited to, a USB connection. The remote device 12 may include an additional processor (not shown) to receive control commands from the wireless controlling device 18 via the apparatus 13.

At various points in FIGS. 4-19 below the processor 26 is described as wirelessly communicating with another device. It should be noted that the wirelessly communicating is typically enabled by the processor 26 instructing the wireless interface 32 to send data wirelessly.

It should be noted that the processor 26 of the remote device 12 is mentioned numerous times in FIGS. 4-19 below. However, it should be noted that the processor 26 is not shown in FIGS. 4-19 in order not to overcomplicate the figures.

Figure 4:
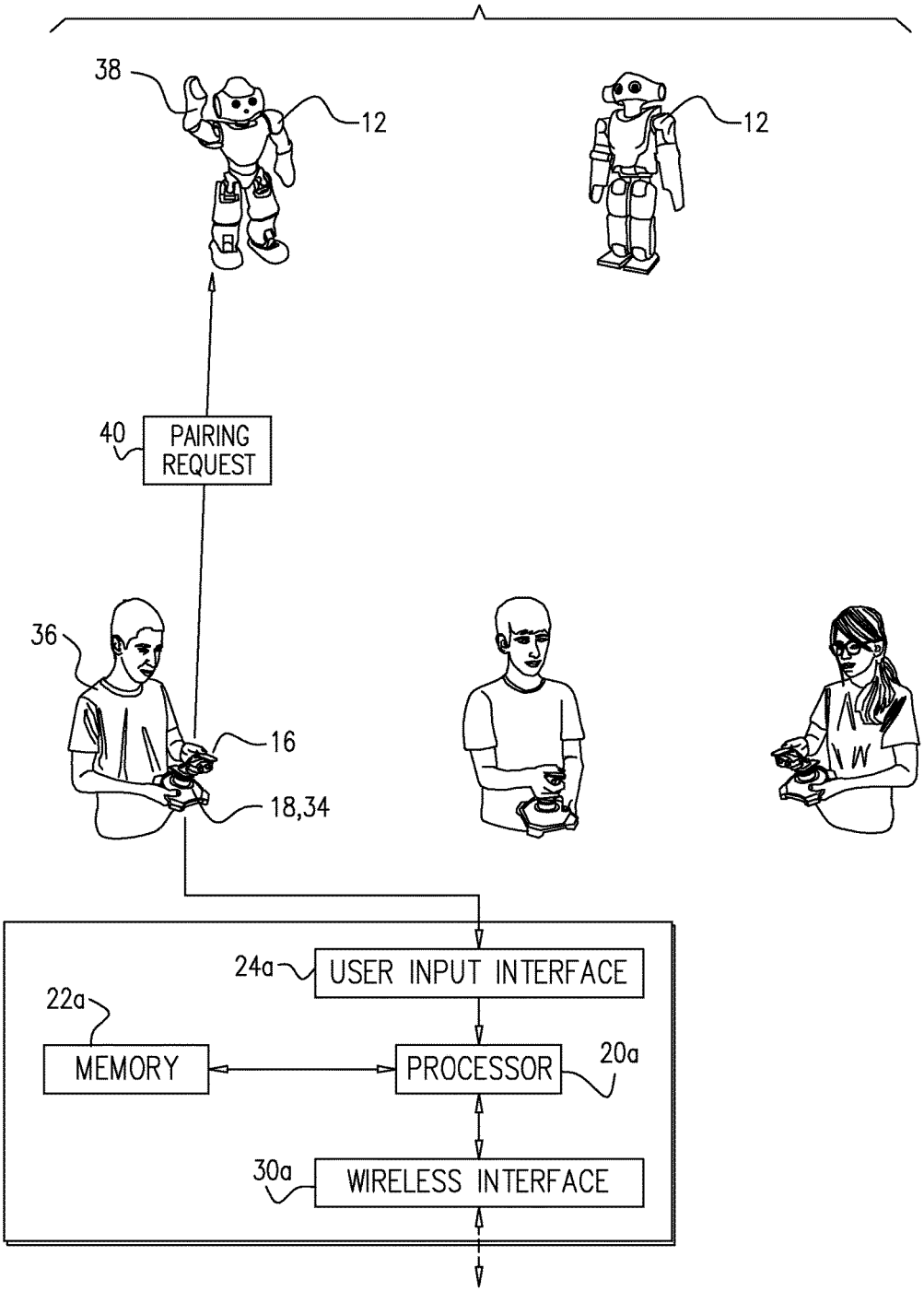
FIGS. 4 and 5 are partly pictorial, partly block diagram views of a wireless controlling device requesting access to, and receiving access control from, the remote device of FIG. 3.
Figure 5:
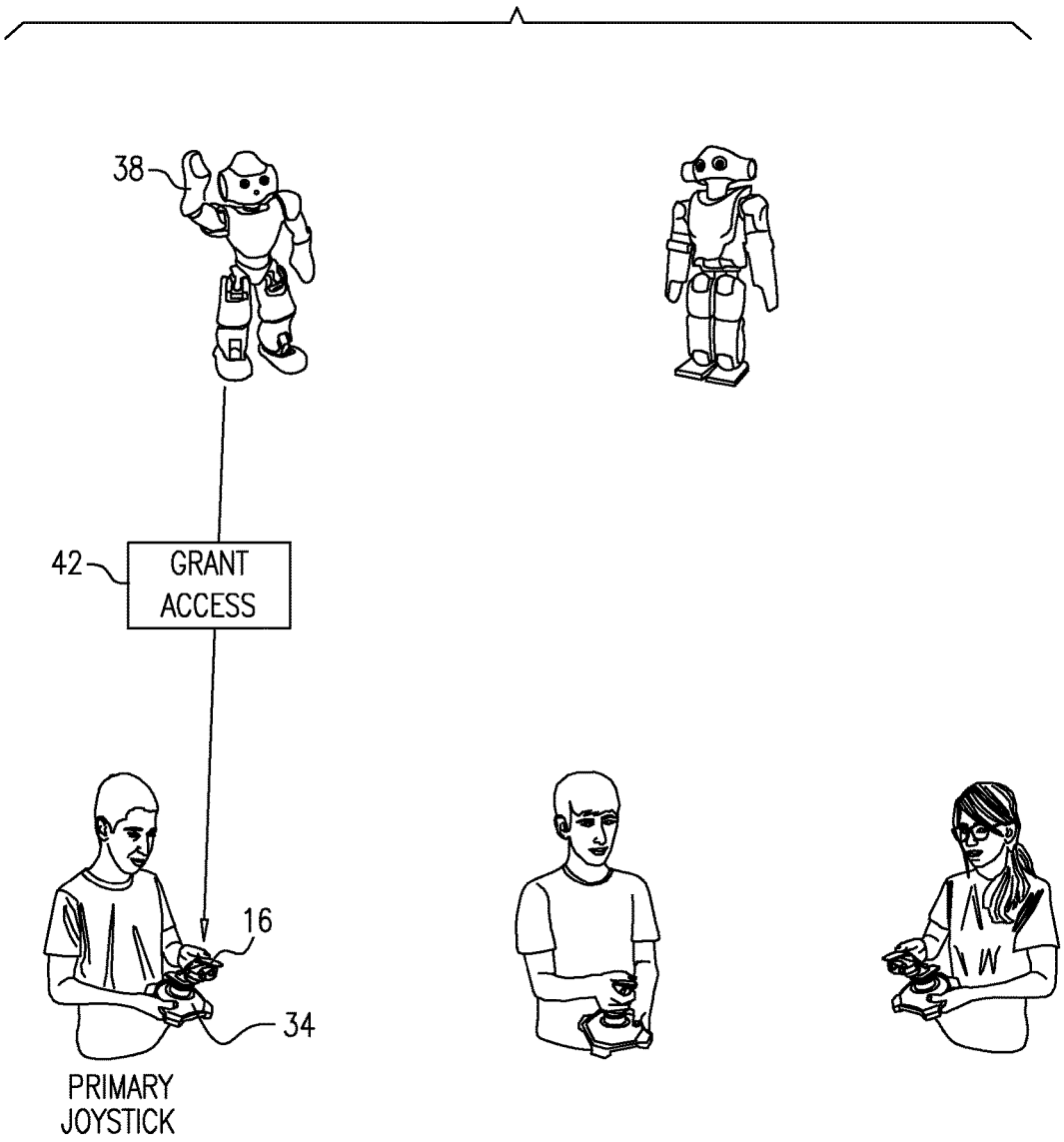

FIGS. 4 and 5 are partly pictorial, partly block diagram views of one of the wireless controlling devices 18 (a wireless controlling device 34) requesting access to, and receiving access control from, one of the remote device 12 of FIG. 3 (a remote device 38).

Reference is now made to FIG. 4.

The wireless controlling device 34 includes a user input interface 24*a*, a processor 20*a*, a memory 22*a*, and a wireless interface 30*a*.

A random key may be generated or specified by a user 36 of the wireless controlling device 34 upon initial running/installation of software on the wireless controlling device 34. The random key is typically used in a pairing request 40 sent by the wireless controlling device 34 to the remote device 38. The random key may also be derived from the MAC Address associated with the wireless interface 30*a* or other attributes of the processor 20*a* or some combination thereof.

The user 36 inputs data (typically an identification number of the selected remote device 38) via a keypad (not shown) of the pointing device 16 connected to the wireless controlling device 34 in order for the wireless controlling device 34 to know which remote device 12 the wireless controlling device 34 is to be connected to. Alternatively, the user 36 may temporarily physically connect the wireless controlling device 34 to the remote device 38 through a wired interface such as USB in order to determine the identity of the remote device 38. Once the identification of the target remote device 38 has been determined and stored in the memory 22*a* of the wireless controlling device 34, the physical connection is no longer required.

The wireless controlling device 34 may use a discovery protocol to locate the remote device 12 corresponding to the identification number of the selected remote device 38 stored in the memory 22*a*.

The processor 20*a* of the wireless controlling device 34 is operative to wirelessly send the pairing request 40 to the remote device 38. The pairing request 40 typically includes a password and may be sent as an http request, for example, but not limited to:

http://<<ipaddress>>/wmodule/exclusiveUse.cgi?acquire=<<password>>.

The processor 26 of the remote device 38 is operative to wirelessly receive the pairing request 40 from the wireless controlling device 34.

At various points in FIGS. 4-19 below the processor 20*a* is described as wirelessly communicating with another device. It should be noted that the wirelessly communicating is typically enabled via the processor 20*a* instructing the wireless interface 30*a* to send data wirelessly.

It should be noted that the processor 20*a* and the user input interface 24*a* are mentioned numerous times in FIGS. 4-19 below. However, it should be noted that the processor 20*a* and the user input interface 24*a* are not shown in FIGS. 4-19 in order not to overcomplicate the figures.

Reference is now made to FIG. 5.

If the password sent in the pairing request 40 (FIG. 4) is in a list of known passwords already accepted by the remote device 38 as legitimate and no other wireless controlling device 18 currently has use of the remote device 38, then the request for use succeeds.

If the remote device 38 does not recognize the password, then the lights (not shown), or some other suitable indicator, on remote device 38 will alert the owner of the remote device 38 that someone is trying to gain use of the remote device 38.

The owner of the remote device 38 can accept the pairing request 40 from the wireless controlling device 34 by pressing a button (not shown), by way of example only, on the remote device 38. Pressing the button causes the password to be added to a known password list and in the future pairing requests including this password may be granted use without prompting the owner to press the button again.

The processor 26 of the remote device 38 is operative to wirelessly send a grant of access 42 to the wireless controlling device 34. The wireless controlling device 34 and its accompanying pointing device 16 are termed the "primary joystick".

The processor 20*a* of the wireless controlling device 34 is operative to wirelessly receive the grant of access 42 from the remote device 38.

Once the wireless controlling device 34 has gained use of the remote device 38, the wireless controlling device 34 can open a TCP connection to a known port 2901 on the remote device 38, by way of example only, and send commands to, and receive responses from, the remote device 38. The wireless controlling device 34 also accepts a connection to port 2901 for use by other wireless controlling devices 18.

Figure 6:
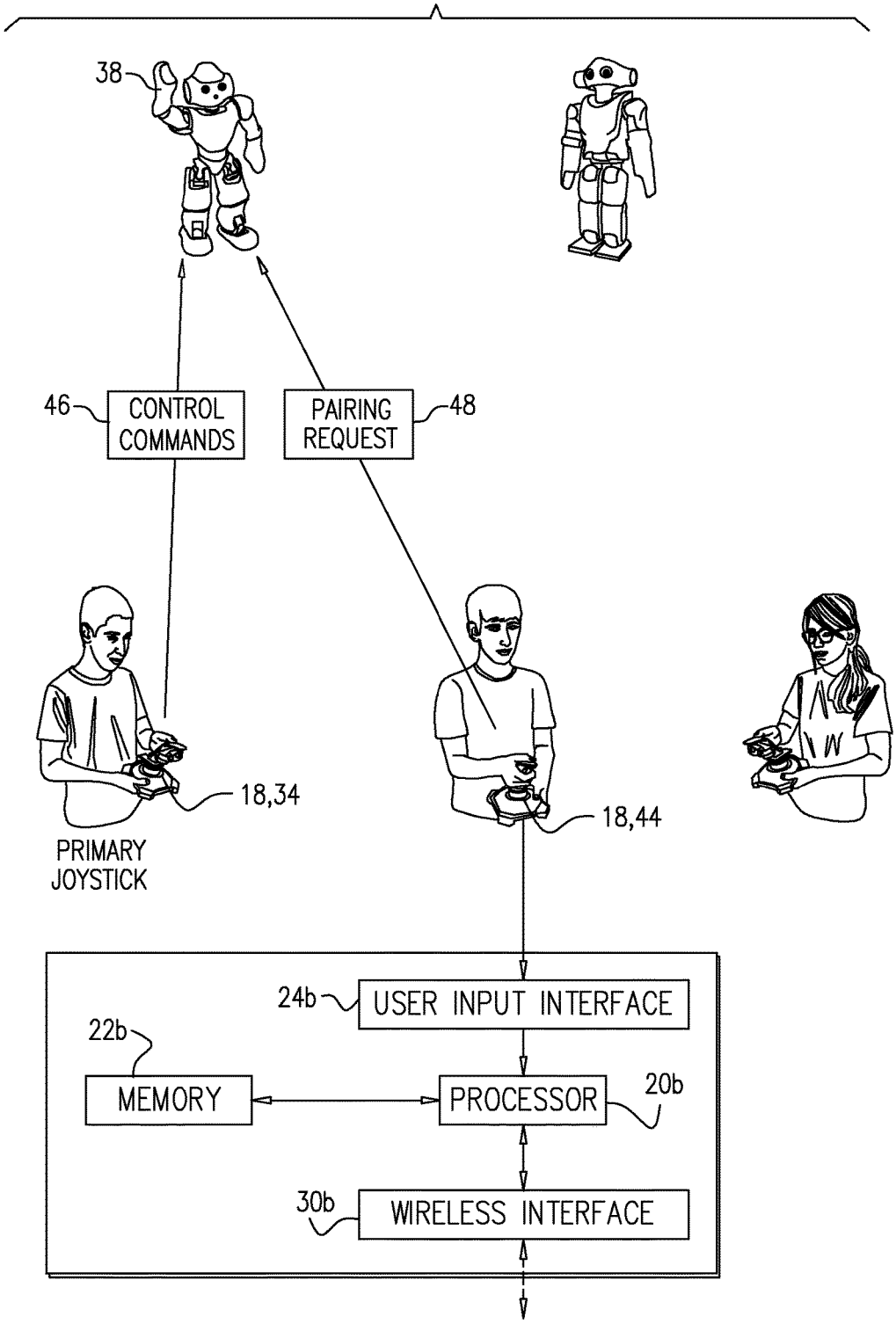
FIGS. 6 and 7 are partly pictorial, partly block diagram views of another wireless controlling device requesting access and being denied access control to the remote device of FIG. 3 and being redirected to the primary wireless controlling device.
Figure 7:
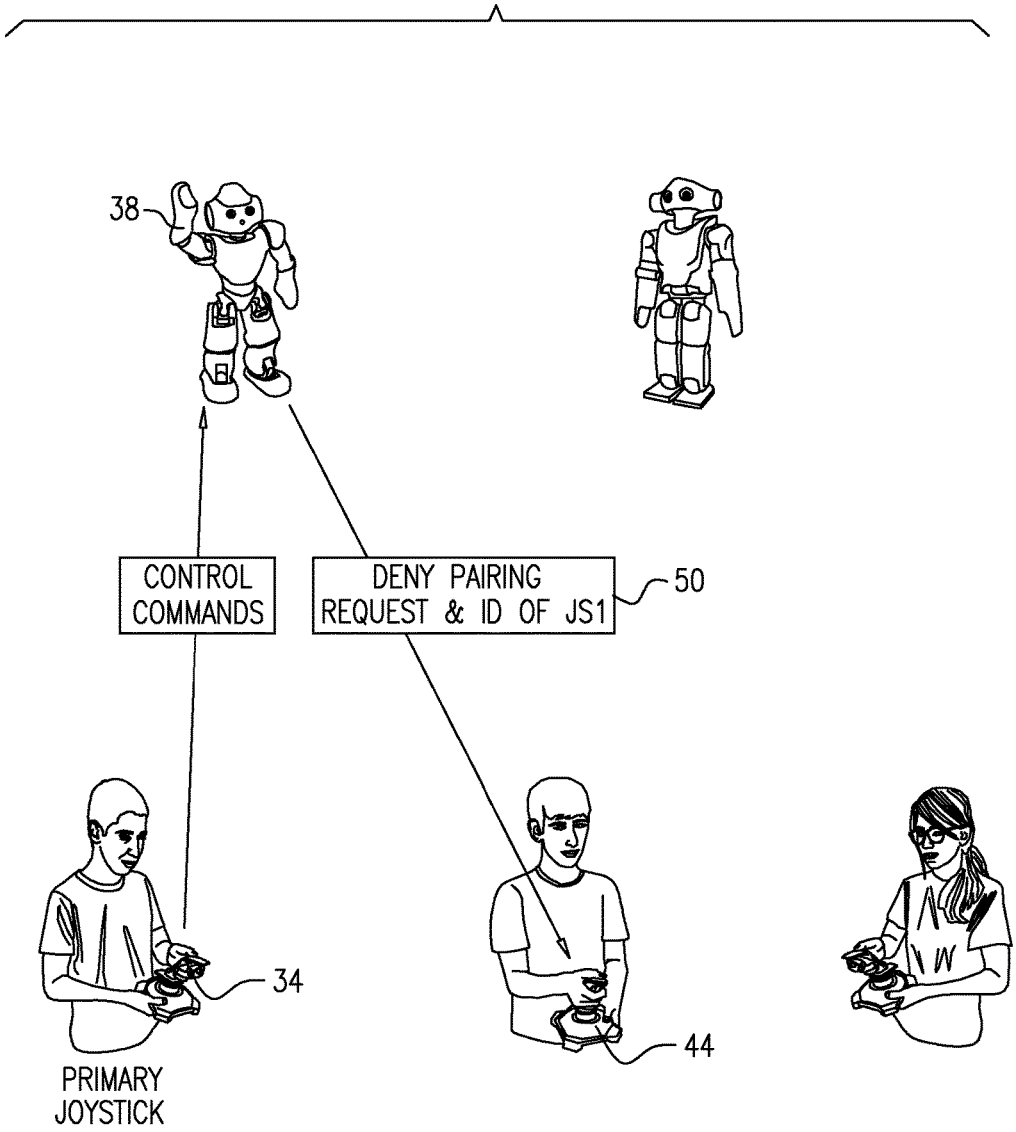

FIGS. 6 and 7 are partly pictorial, partly block diagram views of another wireless controlling device 44 of the wireless controlling devices 18 requesting access and being denied access control to the remote device 38 and being redirected to the primary wireless controlling device 34.

Reference is now made to FIG. 6.

The wireless controlling device 44 includes a user input interface 24*b*, a processor 20*b*, a memory 22*b*, and a wireless interface 30*b*.

The processor 20*a* of the wireless controlling device 34 is operative to receive user input commands from the user input interface 24*a* for controlling the remote device 38 and wirelessly send control commands 46 based on the user input commands to the remote device 38. The processor 26 of the remote device 38 is operative to wirelessly receive the control commands 46 from the wireless controlling device 34 for controlling the remote device 38.

The processor 20*b* of the wireless controlling device 44 is operative to wirelessly send a pairing request 48 to the remote device 38 typically including a password. The processor 26 of the remote device 38 is operative to wirelessly receive the pairing request 48 from the wireless controlling device 44.

At various points in FIGS. 4-19 below the processor 20*b* is described as wirelessly communicating with another device. It should be noted that the wirelessly communicating is typically enabled via the processor 20*b* instructing the wireless interface 30*b* to send data wirelessly.

It should be noted that the processor 20*b* and the user input interface 24*b* are mentioned numerous times in FIGS. 4-19 below. However, it should be noted that the processor 20*b* and the user input interface 24*b* are not shown in FIGS. 4-19 in order not to overcomplicate the figures.

Reference is now made to FIG. 7.

If the remote device 38 processing the pairing request 48 (FIG. 6) is in use by some other client (e.g.: the wireless controlling device 34) which has already acquired use of the remote device 38, then the pairing request 48 will be denied, regardless of the authenticity of the password supplied.

The processor 26 of the remote device 38 is operative to wirelessly send a denial 50 of the pairing request 48 and an identification of the wireless controlling device 34 to the wireless controlling device 44.

The processor 20*b* of the wireless controlling device 44 is operative to wirelessly receive the denial 50 of the pairing request 48 and the identification of the wireless controlling device 34 from the remote device 38. JS1 referred to in block 50 is an abbreviation of joystick 1. Similarly, JS2, as used later in the specification, is an abbreviation of joystick 2.

It should be noted that all the pairing requests described herein include a password. Each wireless controlling device 18 typically uses the same password when connecting to the same remote device 12 or may even use the same password when connecting to any remote device 12. The same password is typically used when connecting to the same remote device 12 via any of the wireless controlling devices 18.

Figure 8:
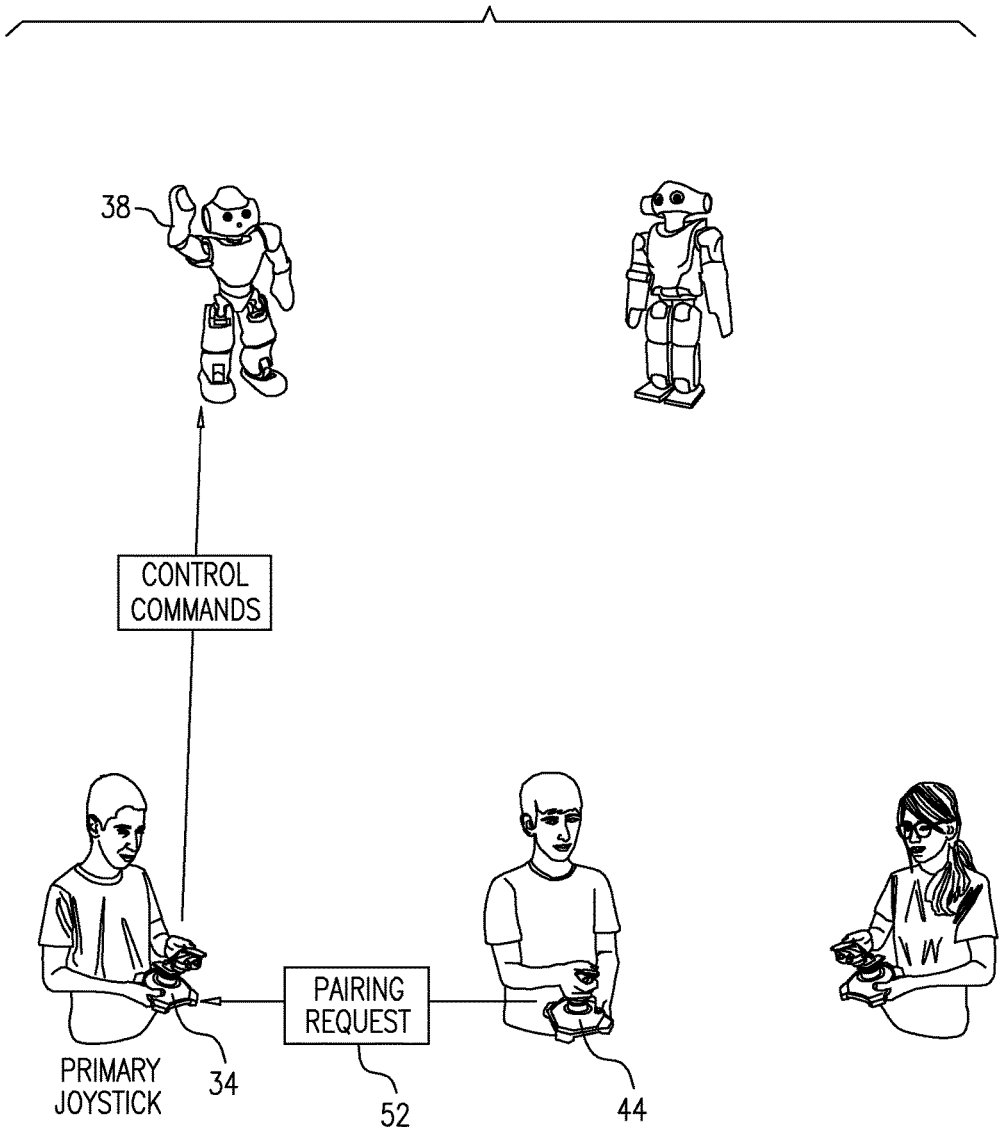
FIGS. 8 and 9 are partly pictorial, partly block diagram views of the other wireless controlling device of FIGS. 6 and 7 requesting and receiving access to the remote device of FIG. 3 via the primary wireless controlling device.
Figure 9:
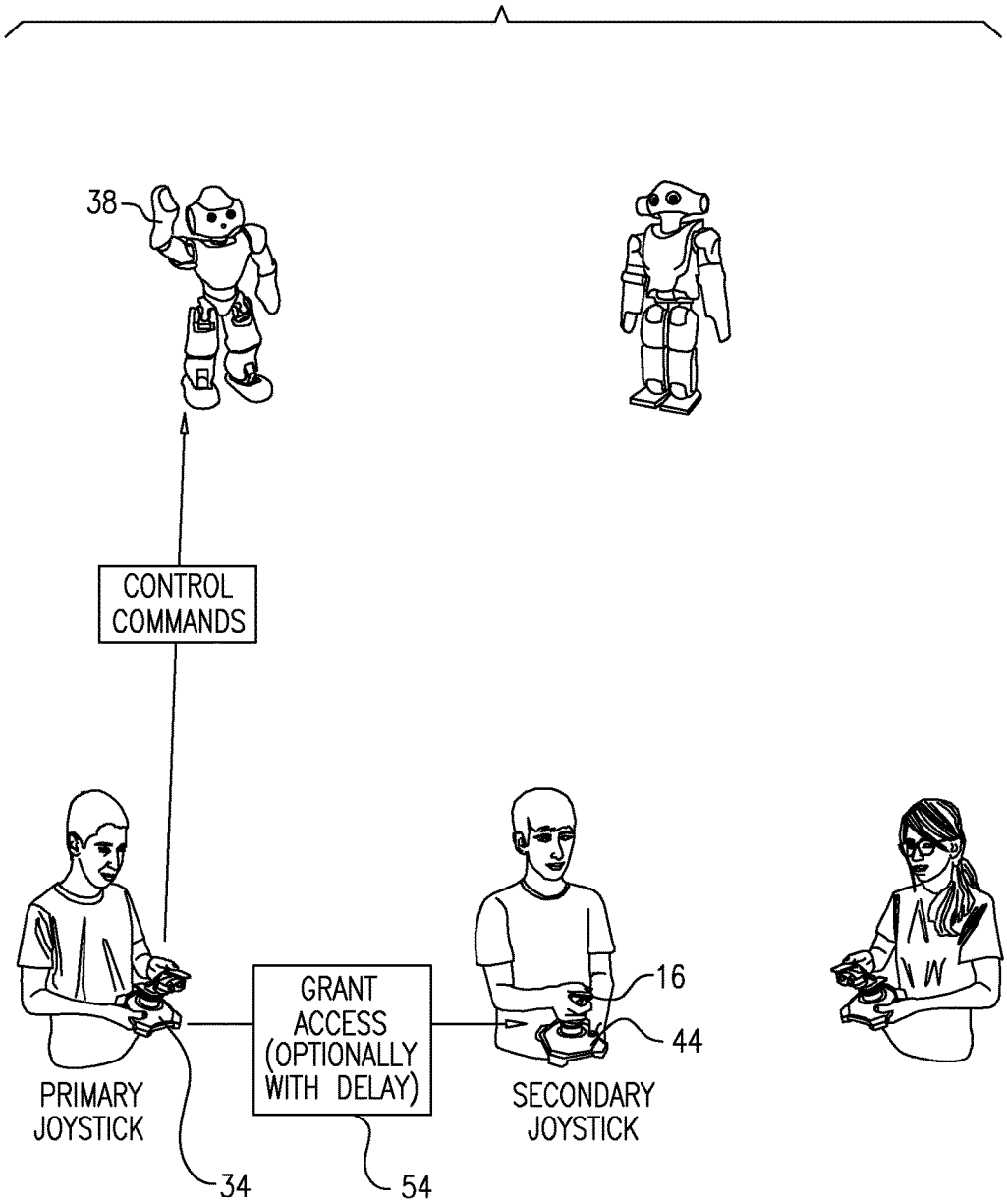

FIGS. 8 and 9 are partly pictorial, partly block diagram views of the wireless controlling device 44 of FIGS. 6 and 7 requesting and receiving access to the remote device 38 of FIG. 4 via the primary wireless controlling device 34.

Reference is now made to FIG. 8.

In response to receiving the denial 50 (FIG. 7), the processor 20*b* of the wireless controlling device 44 is operative to wirelessly send a pairing request 52 (including the same password that was sent to the remote device 38) to the wireless controlling device 34 based on the identification of the wireless controlling device 34 sent to the wireless controlling device 44 with the denial 50 of the pairing request 48 (FIG. 6).

The processor 20*a* of the wireless controlling device 34 is operative to wirelessly receive the pairing request 52 from the wireless controlling device 44.

Reference is now made to FIG. 9.

The processor 20*a* of the wireless controlling device 34 is operative to authenticate the password sent in the pairing request 52 (in a similar way to the remote device 38 authenticating pairing requests from the wireless controlling devices 18 including allowing the user to press a button on the wireless controlling device 34 or physically connecting to the wireless controlling device 34 in order to validate a new password) and wirelessly grant access (block 54) to the wireless controlling device 44. The processor 20*a* of wireless controlling device 34 (or the wireless controlling device 44) is operative to grant access to a device requesting access when the requested device is not currently giving access to another device. The grant of access may be delayed in order to force the timing of control commands from the wireless controlling device 44 to the wireless controlling device 34 to be interspersed with the timing of control commands from the wireless controlling device 34 to the remote device 38, as will be described in more detail with reference to FIG. 11.

The processor 20*b* of the wireless controlling device 44 is operative to wirelessly receive the grant of access (block 54) from the wireless controlling device 34. The wireless controlling device 44 and its accompanying pointing device 16 are then known as the "secondary joystick".

The wireless controlling device 44 establishes a two way connection to wireless controlling device 34 for communicating commands and responses, for example, but not limited to, via TCP port 2901 opened on the wireless controlling device 34. The wireless controlling device 44 also listens to its own TCP port 2901. In such a way, each device 34, 38 listens on a single TCP port 2901 for exclusive access by another device. It should be noted that the term "exclusive access" is in relation to the open port and does not mean that the remote device 38 cannot receive input from other sources such as the user input interface 24*a* of the wireless controlling device 34. It should be noted that the wireless remote control system 10 is not limited to a TCP environment and may be implemented using any suitable communication protocol such as SCTP, Bluetooth, or IEEE 802.15

Figure 10:
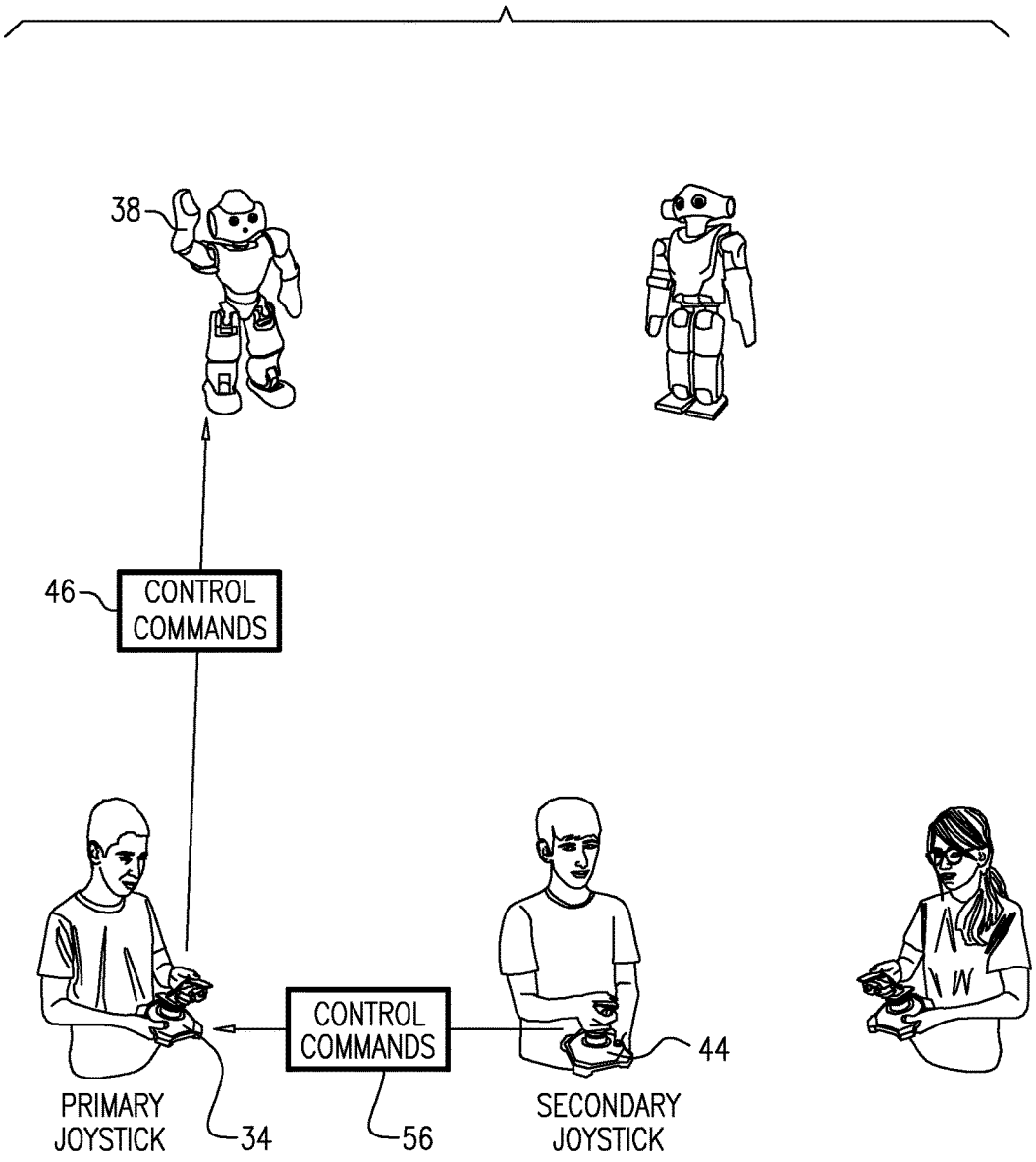
FIG. 10 is a partly pictorial, partly block diagram view of the primary and secondary wireless controlling devices sending control commands to the remote device of FIG. 3.

Reference is now made to FIG. 10, which is a partly pictorial, partly block diagram view of the primary and secondary wireless controlling devices 34, 44 sending control commands 46, 56 to the remote device 38 of FIG. 4.

The processor 20*b* of the wireless controlling device 44 is operative to receive user input commands from the user input interface 24*b* of the wireless controlling device 44 for controlling the remote device 38.

The processor 20*b* of the wireless controlling device 44 is operative to send the control commands 56 to the primary controller, the wireless controlling device 34, as if the wireless controlling device 34 were the remote device 38.

The processor 20*b* of the wireless controlling device 44 is operative to wirelessly send the control commands 56 to the wireless controlling device 34 for controlling the remote device 38 based on the user input commands from the user input interface 24*b* of the wireless controlling device 44.

The processor 20*a* of the wireless controlling device 34 is operative to wirelessly receive the control commands 56 from the wireless controlling device 44 for controlling the remote device 38.

It should be noted that the wireless controlling device 44 does not have to be informed that it is not communicating directly to the remote device 38. It is generally the responsibility of the primary controller (the wireless controlling device 34) to mix together the control commands 56 received from the wireless controlling device 44 into the control commands 46 to the remote device 38.

The processor 20*a* of the wireless controlling device 34 is operative to wirelessly send the control commands 46 to the remote device 38 for controlling the remote device 38 based on the control commands 56 received from the wireless controlling device 44 and the user input commands from the user input interface 24*a* of the wireless controlling device 34.

The processor 26 of the remote device 38 is operative to receive the control commands 46 from the wireless controlling device 34 for controlling the remote device 38.

Figure 11:
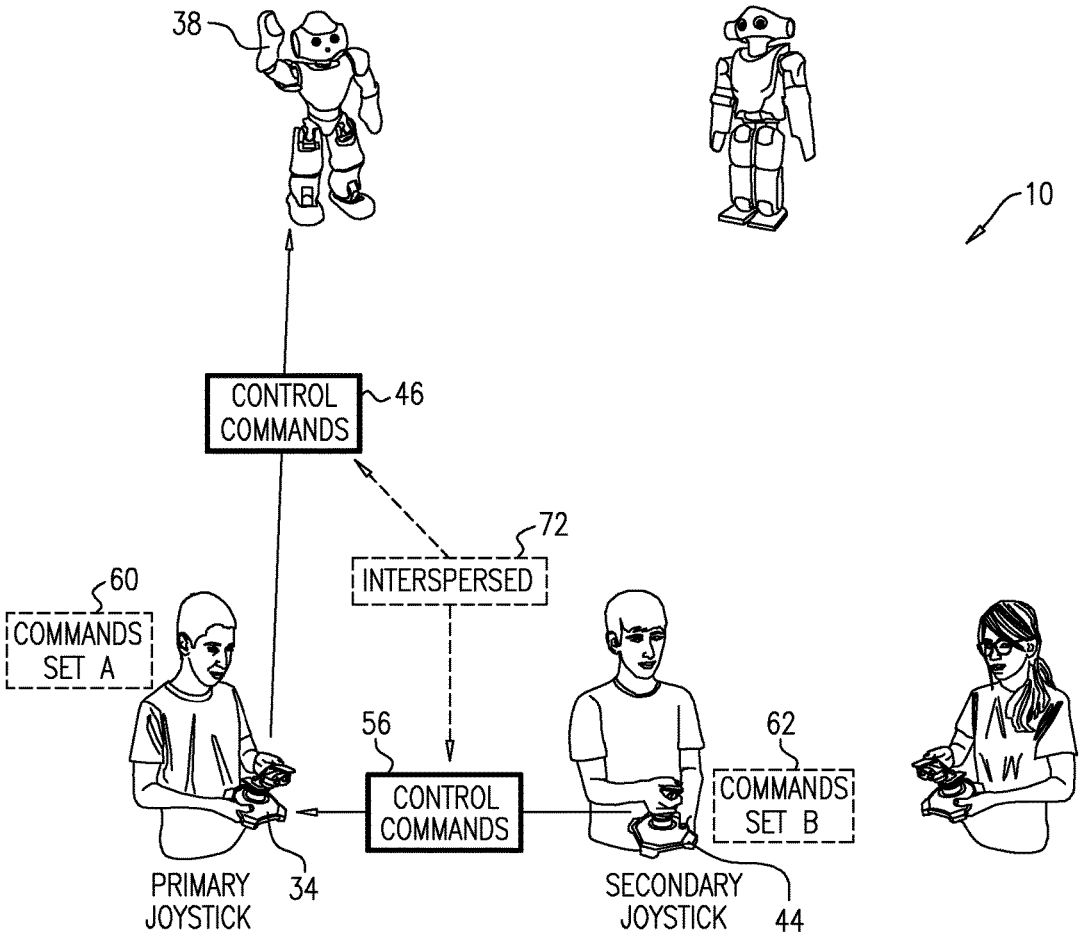
FIG. 11 is a partly pictorial, partly block diagram view of different controlling options in wireless remote control system of FIG. 1.

Reference is now made to FIG. 11, which is a partly pictorial, partly block diagram view of different controlling options in wireless remote control system 10 of FIG. 1.

In some situations a second remote controller may be desirable to allow for an operator to override or assist in the control of a remote device. For example, in a hospital environment where kids are playing with a robot, it is desirable to allow for a second operator to be able to adjust the robot and keep it within safe limits while still allowing the kids to enjoy the control experience.

The processor 20*a* of the wireless controlling device 34 is optionally operative to prepare the control commands 46 for sending to the remote device 38 based on the control commands 56 received from the wireless controlling device 44 and the user input commands from the user input interface 24*a* of the wireless controlling device 34, such that at least one of the user input commands from the user input interface 24*a* of the wireless controlling device 34 overrides at least one of the control commands 56 received from the wireless controlling device 44.

In certain situations it may be convenient to have some of the functions of the remote device 38 controlled by the primary remote controller and some of the functions of the remote device 38 controlled by the secondary remote controller. The processor 20*a* of the wireless controlling device 34 is optionally operative to prepare the control commands 46 for sending to the remote device 38 based on the control commands 56 received from the wireless controlling device 44 and the user input commands from the user input interface 24*a* of the wireless controlling device 34 such that: a first set of functions of the remote device 38 are driven by the user input commands from the user input interface 24*a* of the wireless controlling device 34 (block 60) and not by the control commands 56 received from the wireless controlling device 44; and a second set of functions of the remote device 38 are driven by the control commands 56 received from the wireless controlling device 44 (block 62) and not by the user input commands from the user input interface 24*a* of the wireless controlling device 34. The first set of functions is different from the second set of functions.

Other options for handling control commands are described below.

The processor 20*a* of the wireless controlling device 34 is optionally operative to prepare the control commands 46 for sending to the remote device 38 based on the control commands 56 received from the wireless controlling device 44 and the user input commands from the user input interface 24*a* of the wireless controlling device 34 such that: (a) at least some of the user input commands from the user input interface 24*a* of the wireless controlling device 34 and at least some of the control commands 56 received from the wireless controlling device 44 are averaged or (b) a greater or lesser weight is attributed to the user input commands from the user input interface 24*a* of the wireless controlling device 34 as compared to the control commands 56 received from the wireless controlling device 44 or (c) apply a voting algorithm to pick the most common option (not shown). An example of averaging control commands would be if one user is operating the primary joystick to move the remote device 38 left at normal speed and the user is operating the secondary joystick to move the remote device 38 right at double normal speed, then averaging the commands would result in the remote device 38 moving to the right at the normal speed.

The wireless remote control system 10 may apply one or more of the options listed below to reduce latency caused by having a primary and a secondary remote controller.

It should be noted that the control commands 46, 56 are sent periodically, typically according to some frequency. If there are no commands to be sent the control commands 46, 56 may be sent as a "keep-alive" in order for the receiving device to know that the transmitting device is still operational. In some circumstances, described in more detail below, the control commands 56 may be sent only when there is new information to be conveyed.

After the processor 20*b* of the wireless controlling device 44 has received the grant of access from the wireless controlling device 34, the processor 20*b* of the wireless controlling device 44 is operative to send the control commands 56 to the wireless controlling device 34 for controlling the remote device 38 at a higher frequency than if the wireless controlling device 44 was sending the control commands 56 directly to the remote device 38 and not via the wireless controlling device 34. For example, the wireless controlling device 44 may increase the frequency of sending the control commands 56 from 30 times a second to 60 times a second.

The timing of the sending of the control commands 46, 56 can be interspersed in order to reduce latency. The wireless controlling device 44 may "listen" for when the wireless controlling device 34 is sending the control commands 46 to the remote device 38 and then send the control commands 56 at 50% or 80% (by way of example) of the time after it last "heard" a message being sent from the wireless controlling device 34 to the remote device 38.

Therefore, after the processor 20*b* of the wireless controlling device 44 has received the grant of access (block 54 of FIG. 9) from the wireless controlling device 34, the processor 20*b* of the wireless controlling device 44 is optionally operative to time sending the control commands 56 to the wireless controlling device 34 for controlling the remote device 38 to be interspersed (block 72) with the control commands 46 wirelessly sent from the wireless controlling device 34 to the remote device 38.

The wireless controlling device 34 could cause the wireless controlling device 44 to intersperse the control commands 56 by delaying the response to the pairing request 52 (FIG. 8) in order to force the wireless controlling device 44 to synchronize the sending of the control commands 56 to be interspersed with the control commands 46 for future transmissions of the control commands 46, 56.

Therefore, the processor 20*a* of the wireless controlling device 34 is optionally operative to delay granting access to the wireless controlling device 44 by a certain delay so that the control commands 56 received from the wireless controlling device 44 will be timed to be interspersed with the wirelessly sending the control commands 46 to the remote device 38 by the processor 20*a* of the wireless controlling device 34.

While the wireless controlling device 44 has access to the wireless controlling device 34, the processor 20*b* of the wireless controlling device 44 is optionally operative to only send signals to the wireless controlling device 34 when a user input command is received from the user input interface 24*b* of the wireless controlling device 44 (in other words only send signals when something changes).

Figure 12:
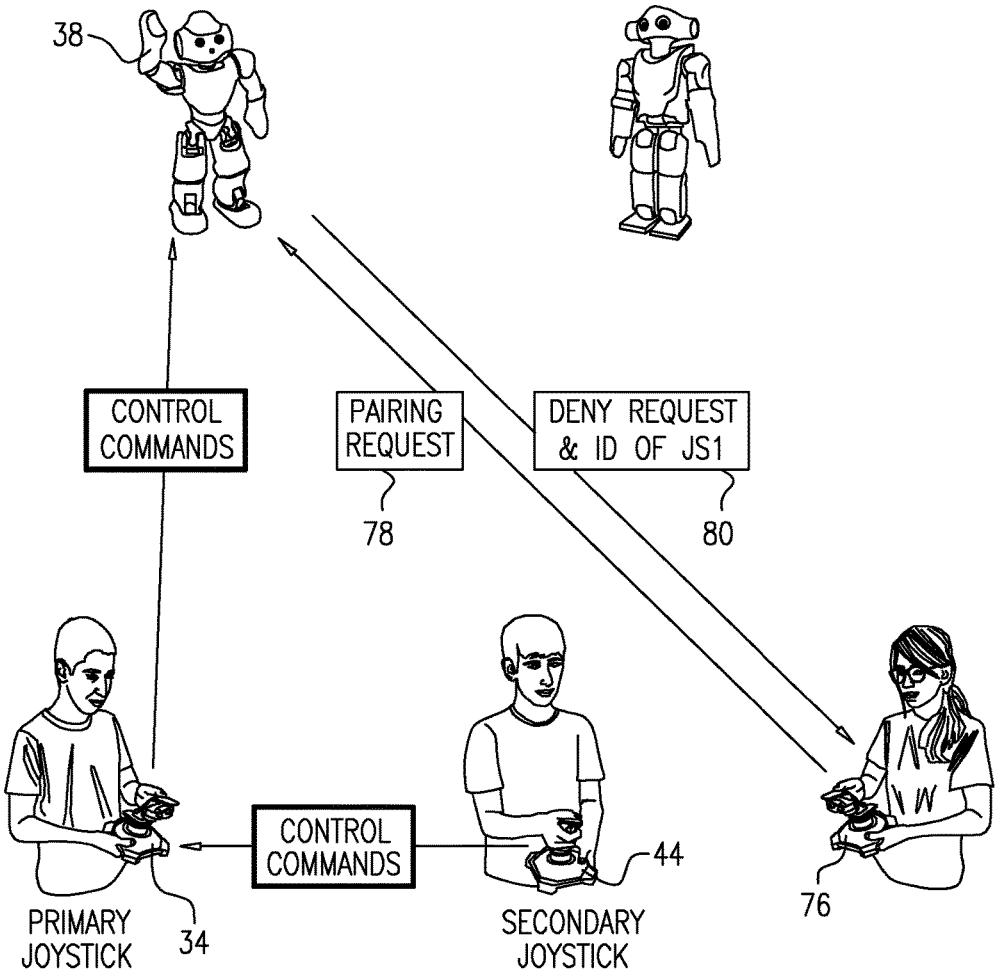
FIGS. 12-14 are partly pictorial, partly block diagram views of yet another wireless controlling device requesting access and being denied access control to the remote device of FIG. 3 and being redirected to the primary wireless controlling device and then to the secondary wireless controlling device.
Figure 13:
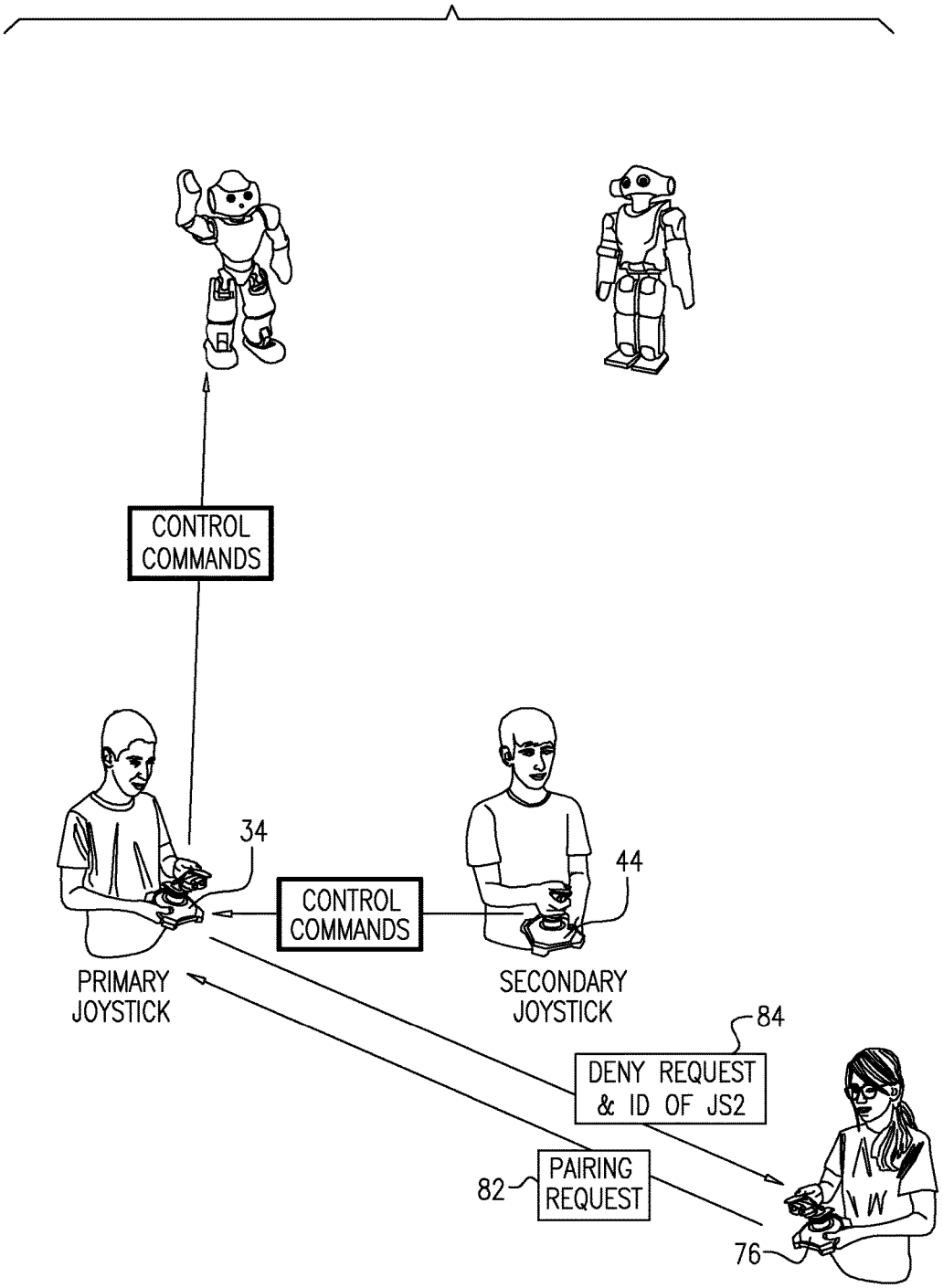
Figure 14:
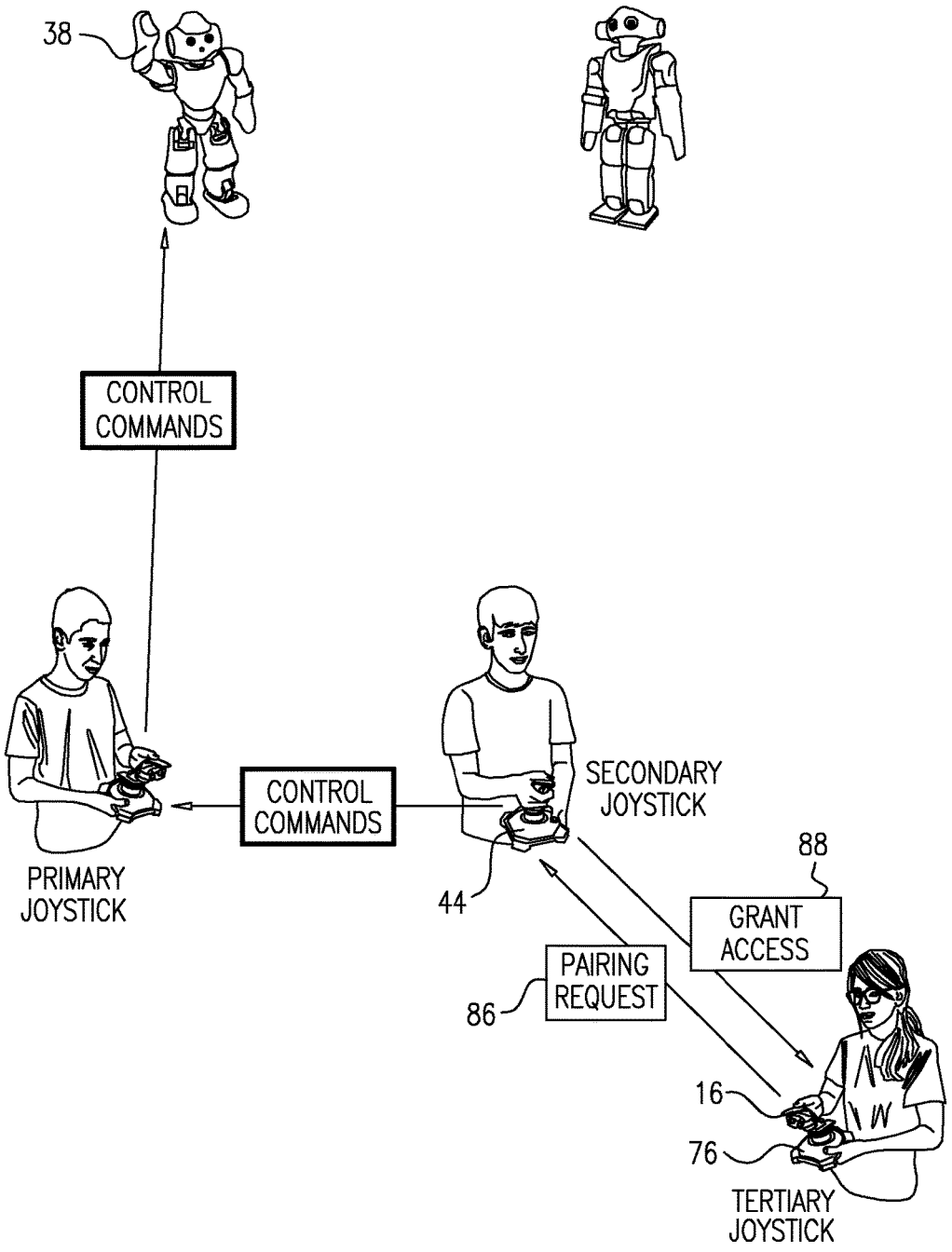

FIGS. 12-14 are partly pictorial, partly block diagram views of yet another wireless controlling device 76 (one of the wireless controlling devices 18 of FIG. 2) requesting access and being denied access control to the remote device 38 and being redirected to the primary wireless controlling device 34 and then to the secondary wireless controlling device 44.

Reference is now made to FIG. 12.

The processor 26 of the remote device 38 is operative to receive a pairing request 78 (including a password) from the wireless controlling device 76 and wirelessly send a denial 80 of the pairing request 78 and an ID of the wireless controlling device 34 to the wireless controlling device 76 as the remote device 38 is already giving access to the wireless controlling device 34.

Reference is now made to FIG. 13.

The processor 20*a* of the wireless controlling device 34 is operative to wirelessly: receive a pairing request 82 (including a password) from the wireless controlling device 76; and send a denial 84 of the pairing request 82 and an identification of the wireless controlling device 44 to the wireless controlling device 76 as the wireless controlling device 34 is already giving access to the wireless controlling device 44.

Reference is now made to FIG. 14.

The processor 20*b* of the wireless controlling device 44 is operative to wirelessly receive a pairing request 86 (including a password) from the wireless controlling device 76, authenticate the password included in the pairing request 86 (in a similar way to the wireless controlling device 34 authenticating the pairing request from the wireless controlling device 44) and wirelessly grant access (block 88) to the wireless controlling device 76. The wireless controlling device 76 now becomes the tertiary wireless controlling device in the chain to the remote device 38. The wireless controlling device 76 and its accompanying pointing device 16 are now known as the "tertiary joystick".

Figure 15:
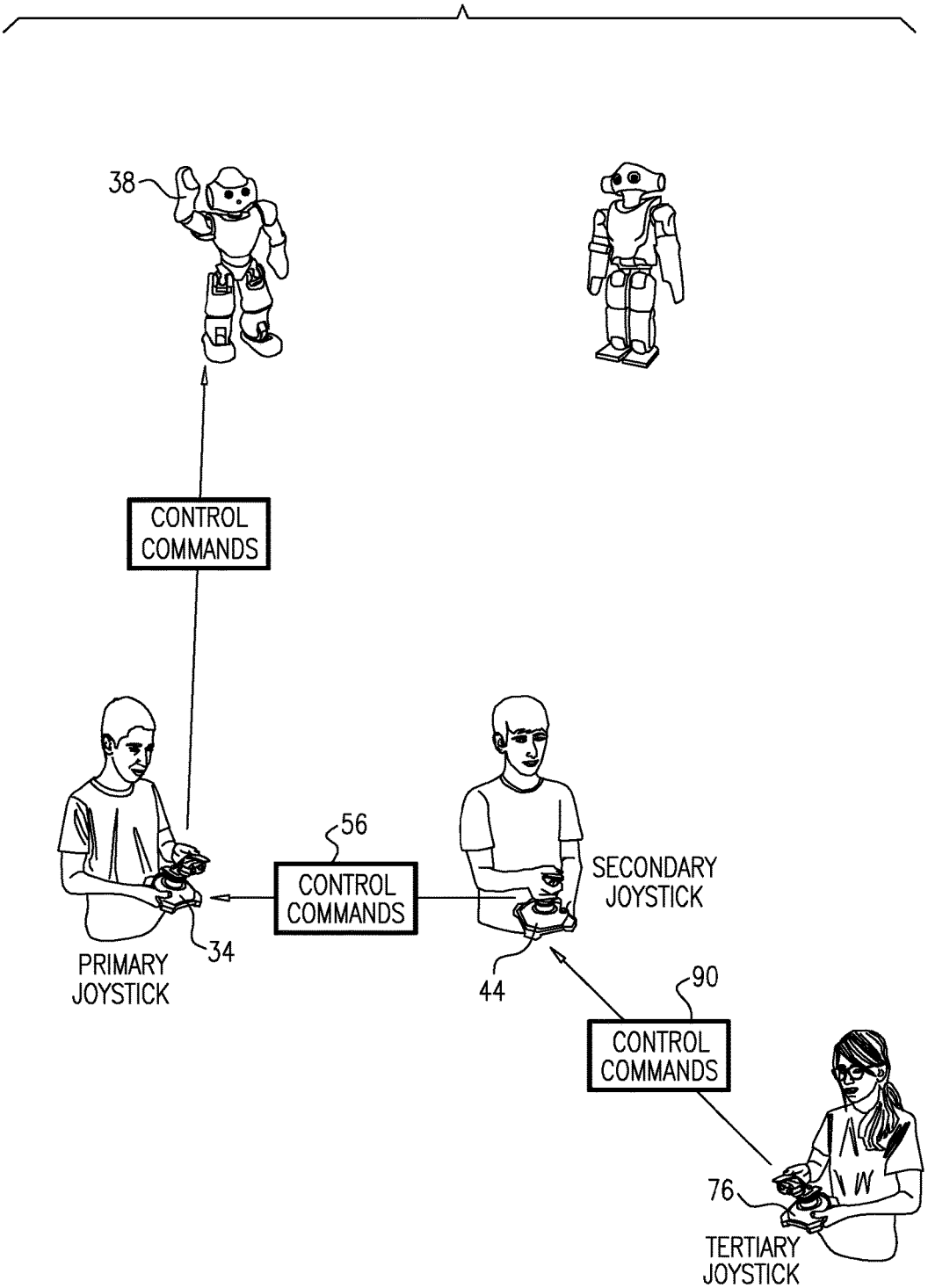
FIG. 15 is a partly pictorial, partly block diagram view of the primary, secondary and tertiary wireless controlling devices sending control commands to the remote device of FIG. 3.

Reference is now made to FIG. 15, which is a partly pictorial, partly block diagram view of the primary, secondary and tertiary wireless controlling devices 34, 44, 76 sending control commands to the remote device 38 of FIG. 3.

The processor 20*b* of the wireless controlling device 44 is operative to wirelessly receive control commands 90 from the wireless controlling device 76 for controlling the remote device 38.

The processor 20*b* of the wireless controlling device 44 is operative to wirelessly send the control commands 56 to the wireless controlling device 34 for controlling the remote device 38 based on the control commands 90 received from the 76 and the user input commands from the user input interface 24*b* of the wireless controlling device 44.

The processor 20*a* of the wireless controlling device 34 is operative to wirelessly receive the control commands 56 from the wireless controlling device 44.

It will be appreciated that two, three or more wireless controlling devices may be daisy chained in such a manner.

FIGS. 16-19 are partly pictorial, partly block diagram views of the primary wireless controlling device 34 losing its connection with the remote device 38 of FIG. 4 and the secondary wireless controlling device 44 becoming the primary wireless controlling device and the primary wireless controlling device 34 becoming the secondary wireless controlling device.

FIGS. 16-19 describe a scenario where only the wireless controlling device 34 and the wireless controlling device 44 are controlling the remote device 38. It has been assumed that the wireless controlling device 76 of FIGS. 12-15 is non-active in FIGS. 16-19.

As the connections between devices are maintained and monitored by the wireless controlling devices, when a wireless controlling device loses a connection to another device, the wireless controlling device repeats the pairing operation starting with the remote device 38 so that the secondary wireless controlling device could end up being the primary wireless controlling device. So for example, control of the remote device 38 can continue even if the primary wireless controlling device loses power (such as dead battery).

Figure 16:
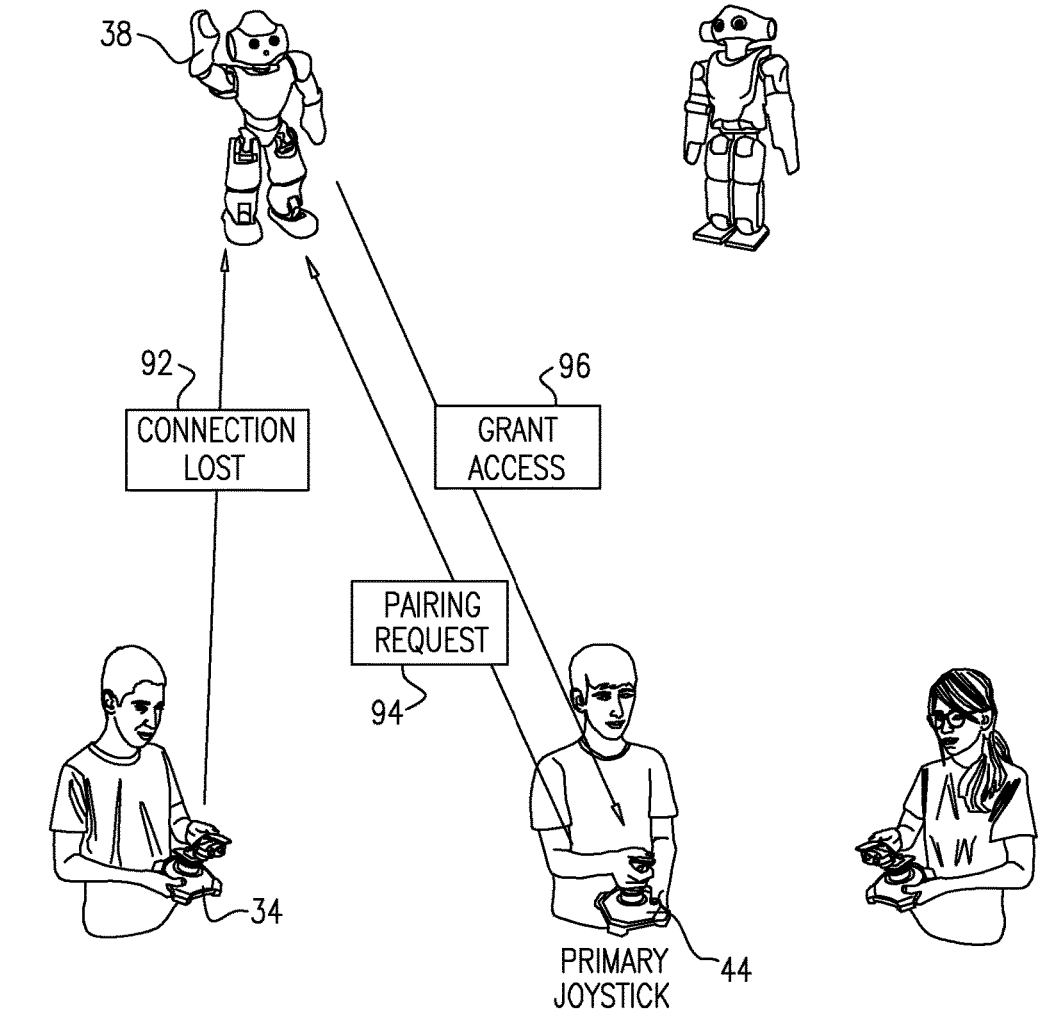
FIGS. 16-19 are partly pictorial, partly block diagram views of the primary wireless controlling device losing its connection with the remote device of FIG. 3 and the secondary wireless controlling device becoming the primary wireless controlling device and the primary wireless controlling device becoming the secondary wireless controlling device.

Reference is now made to FIG. 16.

After the wireless controlling device 34 loses a connection with the remote device 38 (block 92), (the connection between the wireless controlling devices 34, 44 is also severed, either because the wireless controlling device 34 lost power or because the wireless controlling device 34 closed the connection to the wireless controlling device 44 when the wireless controlling device 34 recognized that it lost the connection to the remote device 38) the processor 20*b* of the wireless controlling device 44 is operative, in response to losing the connection, to wirelessly send a pairing request 94 (including a password) to the remote device 38 and the processor 26 of the remote device 38 is operative to wirelessly receive the pairing request 94 from the wireless controlling device 44 and send a grant of access 96 to the wireless controlling device 44. The processor 20*b* of the wireless controlling device 44 is operative to receive the grant of access 96 from the remote device 38.

It should be noted that if the wireless controlling device 76 (FIG. 15) was connected to the wireless controlling device 44 when the wireless controlling device 34 loses the connection to the remote device 38, the connection between the wireless controlling device 76 and the wireless controlling device 44 would also be severed and all three wireless controlling devices 34, 44, 76 would need to reconnect to the remote device 38 directly or via another one or more of the wireless controlling devices 18 using the pairing process described above with reference to FIGS. 4-15.

Figure 17:
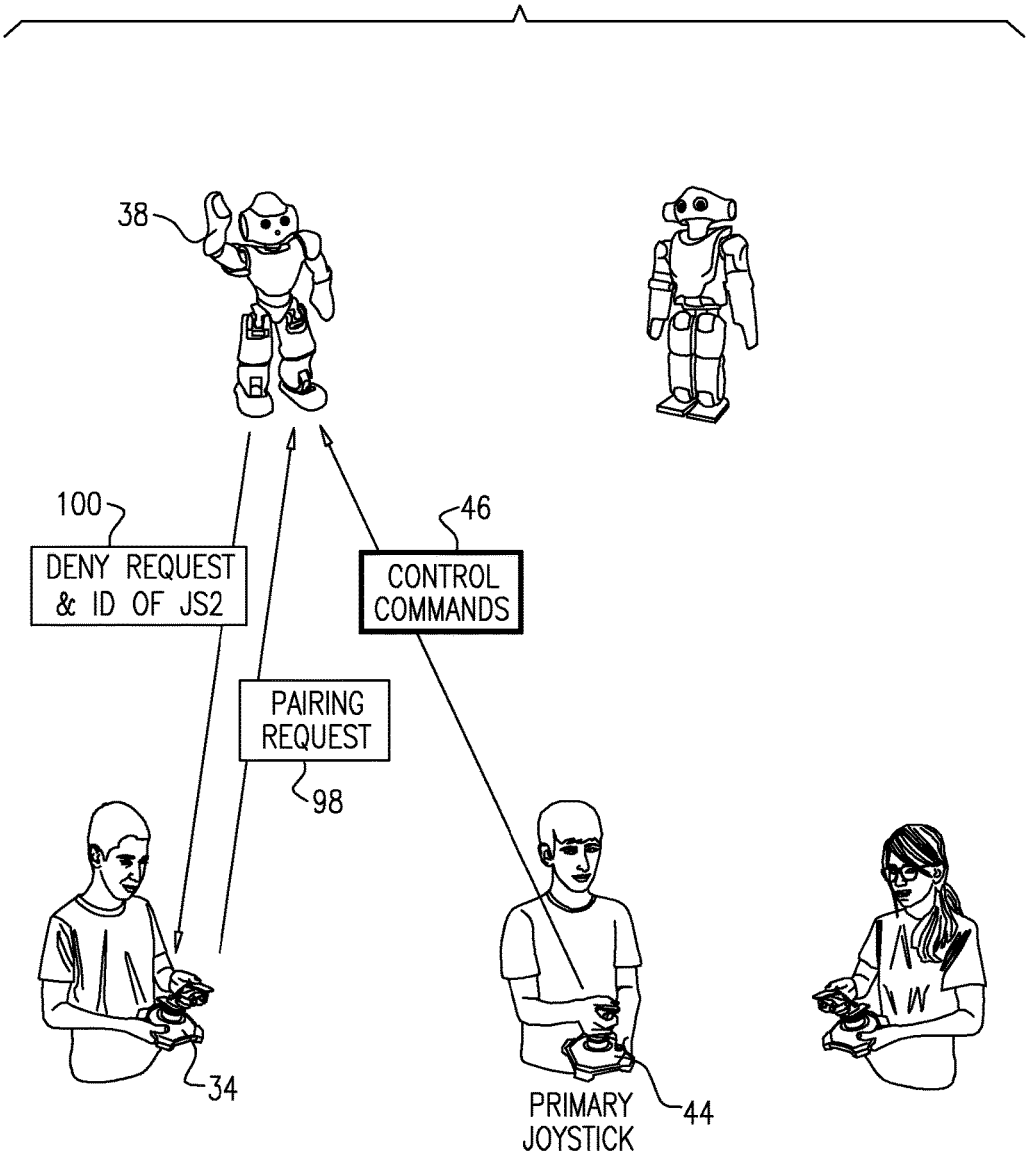

Reference is now made to FIG. 17.

The processor 20*b* of the wireless controlling device 44 is operative to send the control commands 46 to the remote device 38 for controlling the remote device 38 based on the user input commands from the user input interface 24*b* of the wireless controlling device 44. The processor 26 of the remote device 38 is operative to wirelessly receive the control commands 46 from the wireless controlling device 44 for controlling the remote device 38.

After the wireless controlling device 34 loses a connection with the remote device 38, the processor 20*a* of the wireless controlling device 34, in response to losing the connection, is operative to wirelessly send a pairing request 98 (including a password) to the remote device 38. The processor 26 of the remote device 38 is operative to wirelessly receive the pairing request 98 from the wireless controlling device 34.

The processor 26 of the remote device 38 is operative to wirelessly send a denial 100 of the pairing request 98 and an identification of the wireless controlling device 44 to the wireless controlling device 34.

The processor 20*a* of the wireless controlling device 34 is operative to receive the denial 100 of the pairing request 98 and the identification of the wireless controlling device 44 from the remote device 38.

Figure 18:
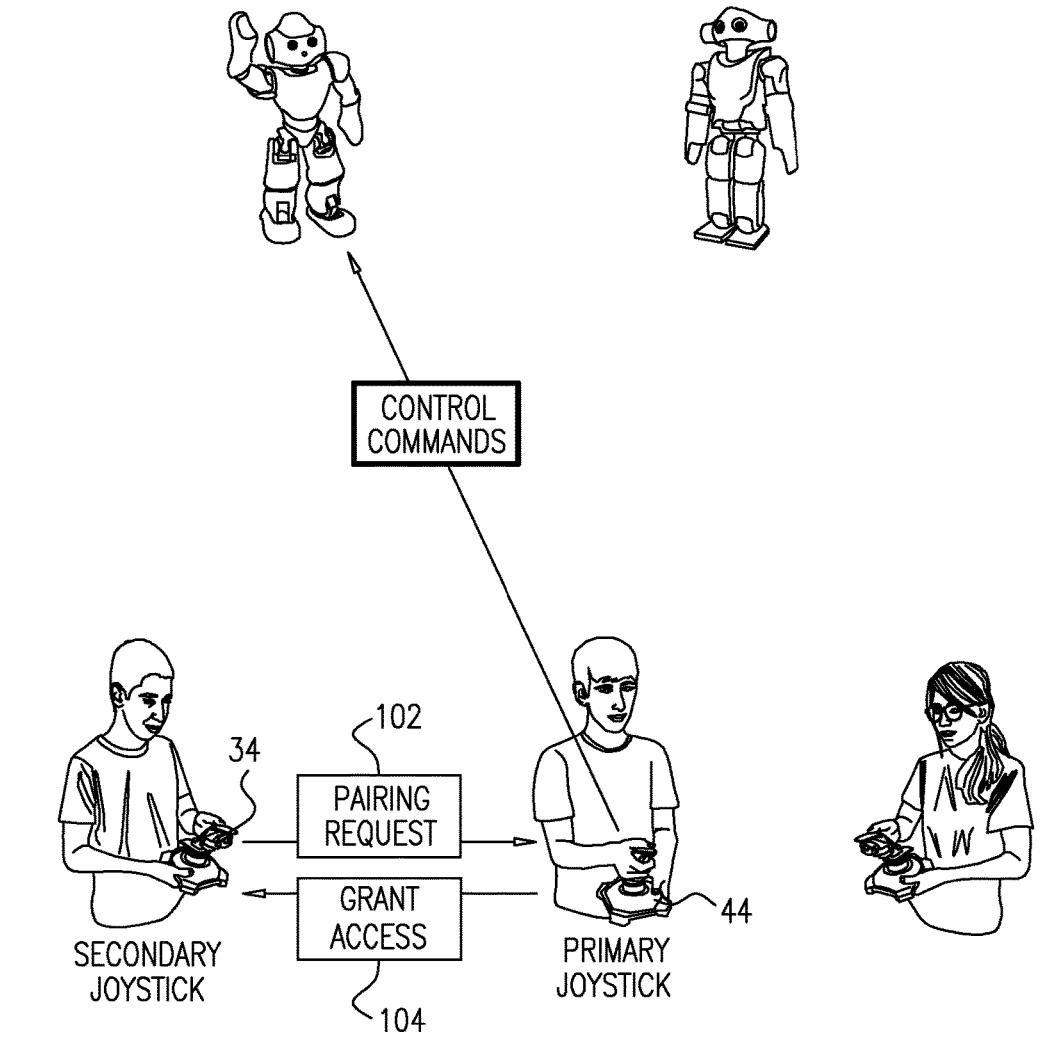

Reference is now made to FIG. 18.

Then in response to receiving the denial 100, the processor 20*a* of the wireless controlling device 34 is operative to send a pairing request 102 (including a password) to the wireless controlling device 44.

The processor 20*b* of the wireless controlling device 44 is operative to wirelessly receive the pairing request 102 from the wireless controlling device 34.

The processor 20*b* of the wireless controlling device 44 is operative to wirelessly grant access (block 104) to the wireless controlling device 34.

The processor 20*a* of the wireless controlling device 34 is operative to wirelessly receive the grant of access (block 104) from the wireless controlling device 44.

Figure 19:
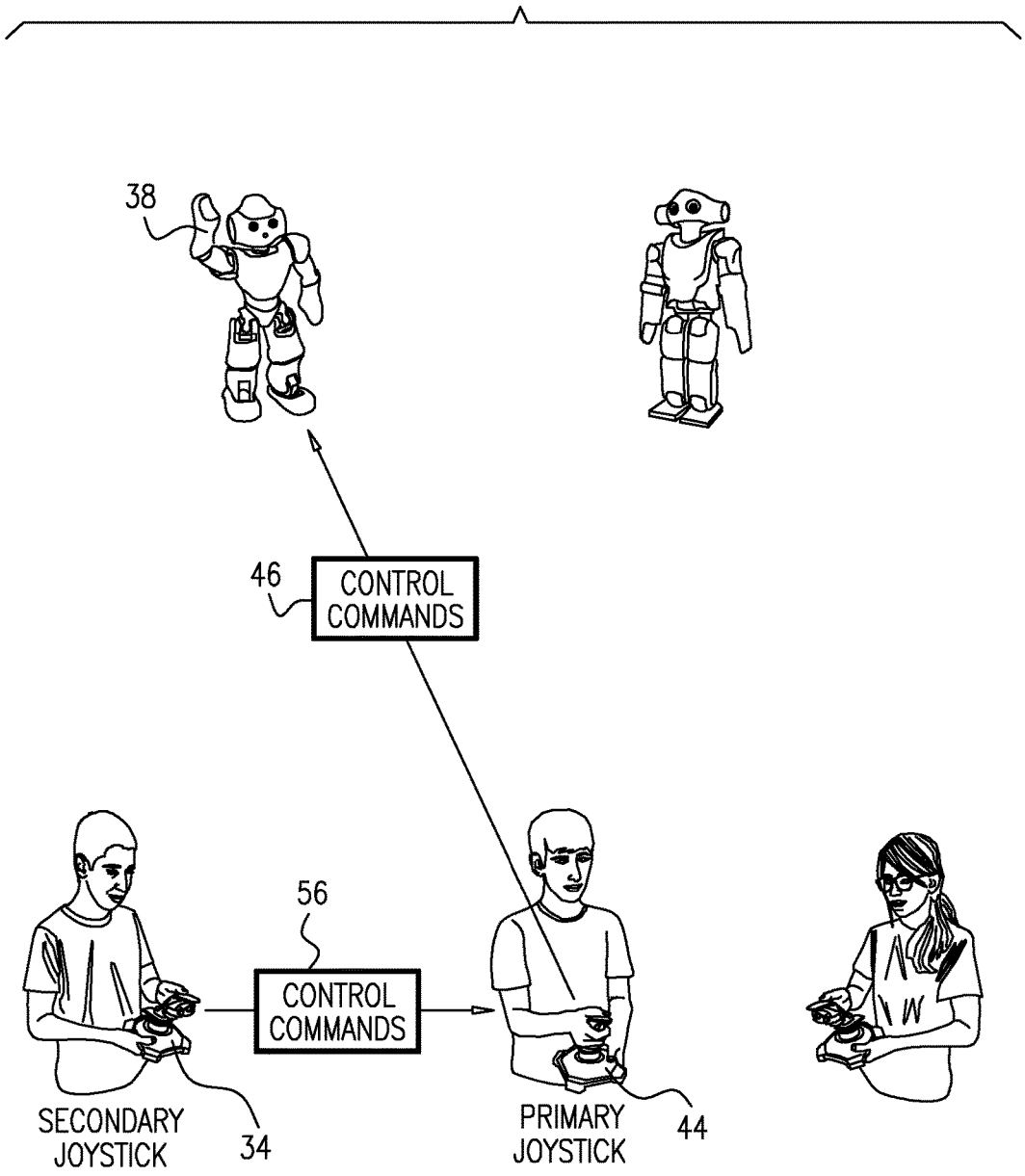

Reference is now made to FIG. 19

Then, the processor 20*a* of the wireless controlling device 34 is operative to send control commands 56 to the wireless controlling device 44 for controlling the remote device 38 based on the user input commands from the user input interface 24*a* of the wireless controlling device 34.

The processor 20*b* of the wireless controlling device 44 is operative to wirelessly receive the control commands 56 from the wireless controlling device 34 for controlling the remote device 38.

The processor 20*b* of the wireless controlling device 44 is operative to wirelessly send the control commands 46 to the remote device 38 for controlling the remote device 38 based on the control commands 56 received from the wireless controlling device 34 and the user input commands from the user input interface 24*b* of the wireless controlling device 44.

Reference is again made to FIG. 2.

The pointing device 16 may use buttons or a touch pad or other suitable interface to set a mode of operation, such as idle mode, autonomous mode (run by itself based on pre-programmed operation whereby the remote control just sends a "heartbeat"), timed tele-op mode (tele-op mode being a mode in which human operators control the remote device 38 functions using joysticks or other pointing devices), permanent tele-op mode by way of example only. Either the primary or secondary joystick may set the mode. Typically, only the primary joystick can start a match/game, but optionally the primary joystick can inform the remote device 12 that a match has started if it sees that the secondary joystick started the match. Any joystick may broadcast to other joysticks listening to the network in the match that the game has started.

In practice, some or all of the above described functions may be combined in a single physical component or, alternatively, implemented using multiple physical components. These physical components may comprise hard-wired or programmable devices, or a combination of the two. In some embodiments, at least some of the functions of the processing circuitry may be carried out by a programmable processor under the control of suitable software. This software may be downloaded to a device in electronic form, over a network, for example. Alternatively or additionally, the software may be stored in tangible, non-transitory computer-readable storage media, such as optical, magnetic, or electronic memory.

It is appreciated that software components may, if desired, be implemented in ROM (read only memory) form. The software components may, generally, be implemented in hardware, if desired, using conventional techniques. It is further appreciated that the software components may be instantiated, for example: as a computer program product or on a tangible medium. In some cases, it may be possible to instantiate the software components as a signal interpretable by an appropriate computer, although such an instantiation may be excluded in certain embodiments of the present invention.

It will be appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable sub-combination.

It will be appreciated by persons skilled in the art that the present invention is not limited by what has been particularly shown and described hereinabove. Rather the scope of the invention is defined by the appended claims and equivalents thereof.

What is claimed is:

1. A first controlling device comprising: a processor; a memory to store data used by the processor; and a user input interface, wherein the processor is operative to:

wirelessly send a first pairing request to a remote device;

wirelessly receive a grant of access from the remote device;

receive user input commands from the user input interface for controlling the remote device;

wirelessly receive a second pairing request from a second controlling device;

wirelessly grant access to the second controlling device;

wirelessly receive control commands from the second controlling device for controlling the remote device; and wirelessly send control commands to the remote device for controlling the remote device, the sent control commands being based on: the control commands received from the second controlling device; and the user input commands from the user input interface, wherein, after the first controlling device loses a connection with the remote device, the processor is operative to wirelessly:

in response to losing the connection, send a third pairing request to the remote device;

receive a denial of the third pairing request and an identification of the second controlling device from the remote device;

in response to receiving the denial, send a fourth pairing request to the second controlling device;

receive a grant of access from the second controlling device; and send control commands to the second controlling device for controlling the remote device based on the user input commands from the user input interface.

2. The first controlling device according to claim 1, wherein the processor is operative to prepare the control commands for sending to the remote device based on the control commands received from the second controlling device and the user input commands from the user input interface such that a first set of functions of the remote device are driven by the user input commands and not by the control commands received from the second controlling device and a second set of functions of the remote device are driven by the control commands received from the second controlling device and not by the user input commands, the first set of functions being different from the second set of functions.

3. The first controlling device according to claim 1, wherein the processor is operative to prepare the control commands for sending to the remote device based on the control commands received from the second controlling device and the user input commands from the user input interface such that at least one of the user input commands overrides at least one of the control commands received from the second controlling device.

4. The first controlling device according to claim 1, wherein the processor is operative to prepare the control commands for sending to the remote device based on the control commands received from the second controlling device and the user input commands from the user input interface such that: (a) at least some of the user input commands and at least some of the control commands received from the second controlling device are averaged; or (b) a greater or lesser weight is attributed to the user input commands as compared to the control commands received from the second controlling device.

5. The first controlling device according to claim 1, wherein the processor is operative to delay granting access to the second controlling device by a certain delay so that the control commands received from the second controlling device will be timed to be interspersed with the wirelessly sending the control commands to the remote device by the processor.

6. A second controlling device comprising: a processor; a memory to store data used by the processor; and a user input interface, wherein the processor is operative to:

wirelessly send a first pairing request to a remote device;

wirelessly receive a denial of the first pairing request and an identification of a first controlling device from the remote device;

in response to receiving the denial, wirelessly send a second pairing request to the first controlling device;

wirelessly receive a grant of access from the first controlling device;

receive user input commands from the user input interface for controlling the remote device; and wirelessly send control commands to the first controlling device for controlling the remote device based on the user input commands from the user input interface.

7. The second controlling device according to claim 6, wherein, after the first controlling device loses a connection with the remote device, the processor is operative to wirelessly:

in response to losing the connection, send a third pairing request to the remote device;

receive a grant of access from the remote device; and send control commands to the remote device for controlling the remote device based on the user input commands from the user input interface.

8. The second controlling device according to claim 7, wherein the processor is operative to wirelessly:

receive a fourth pairing request from the first controlling device;

grant access to the first controlling device;

receive control commands from the first controlling device for controlling the remote device; and send control commands to the remote device for controlling the remote device based on the control commands received from the first controlling device and the user input commands from the user input interface.

9. The second controlling device according to claim 6, wherein the processor is operative to wirelessly:

receive a fifth pairing request from a third controlling device;

grant access to the third controlling device;

receive control commands from the third controlling device for controlling the remote device; and send control commands to the first controlling device for controlling the remote device based on the control commands received from the third controlling device and the user input commands from the user input interface.

10. The second controlling device according to claim 6, wherein the user input interface is operative to receive the user input commands from a pointing device.

11. The second controlling device according to claim 6, wherein after the processor has received the grant of access from the first controlling device, the processor is operative to send the control commands to the first controlling device for controlling the remote device at a higher frequency than if the second controlling device was sending the control commands directly to the remote device and not via the first controlling device.

12. The second controlling device according to claim 6, wherein while the second controlling device has access to the first controlling device, the processor is operative to only send signals to the first controlling device when one of the user input commands is received from the user input interface.

13. The second controlling device according to claim 6, wherein after the processor has received the grant of access from the first controlling device, the processor is operative to time sending the control commands to the first controlling device for controlling the remote device to be interspersed with a plurality of control commands wirelessly sent from the first controlling device to the remote device.

14. An apparatus comprising: a processor; and a memory to store data used by the processor, wherein the processor is operative to wirelessly:

receive a first pairing request from a first controlling device;

send a grant of access to the first controlling device;

receive control commands from the first controlling device for controlling a remote device;

receive a second pairing request from a second controlling device; and send a denial of the second pairing request and an identification of the first controlling device to the second controlling device.

15. The apparatus according to claim 14, wherein after the first controlling device loses a connection with the remote device, the processor is operative to wirelessly:

receive a third pairing request from the second controlling device;

send a grant of access to the second controlling device;

receive control commands from the second controlling device for controlling the remote device;

receive a fourth pairing request from the first controlling device; and send a denial of the fourth pairing request and an identification of the second controlling device to the first controlling device.

16. A device controlling method comprising:

wirelessly sending a first pairing request to a remote device;

wirelessly receiving a denial of the first pairing request and an identification of a first controlling device from the remote device;

in response to receiving the denial, wirelessly sending a second pairing request to the first controlling device;

wirelessly receiving a grant of access from the first controlling device;

receiving user input commands from a user input interface of a second controlling device for controlling the remote device; and wirelessly sending control commands to the first controlling device for controlling the remote device based on the user input commands from the user input interface.

17. A device controlling method comprising:

receiving a first pairing request from a first controlling device;

sending a grant of access to the first controlling device;

receiving control commands from the first controlling device;

receiving a second pairing request from a second controlling device; and sending a denial of the second pairing request and an identification of the first controlling device to the second controlling device.

* * * * *